US012668336B2

(12) United States Patent
Blanchard

(10) Patent No.: US 12,668,336 B2
(45) Date of Patent: Jun. 30, 2026

(54) VESSEL STABILIZING APPARATUS

(71) Applicant: Tod M Blanchard, Litchfield, NH (US)

(72) Inventor: Tod M Blanchard, Litchfield, NH (US)

( * ) Notice: Subject to any disclaimer, the term of this patent is extended or adjusted under 35 U.S.C. 154(b) by 260 days.

(21) Appl. No.: 18/680,917

(22) Filed: May 31, 2024

(65) Prior Publication Data

US 2025/0368303 A1 Dec. 4, 2025

(51) Int. Cl.
*B63B 43/14* (2006.01)

(52) U.S. Cl.
CPC ..... *B63B 43/14* (2013.01)

(58) Field of Classification Search
CPC ..... B63B 43/14; B63B 43/04
See application file for complete search history.

(56) References Cited

U.S. PATENT DOCUMENTS 1,336,688 A * 4/1920 Ferko ..... B63B 43/14 114/123
4,641,594 A 2/1987 Birkett
5,582,126 A 12/1996 Rypinski
6,050,210 A * 4/2000 Grzybowski ..... B63B 43/14 114/123
6,305,306 B1 * 10/2001 Grzybowski ..... B63B 43/14 114/283
6,659,032 B1 * 12/2003 Simon ..... B63B 43/14 114/123
6,855,016 B1 2/2005 Jansen
8,047,153 B2 11/2011 Wood
D957,304 S 7/2022 Cobb, Jr.
2012/0060737 A1 * 3/2012 Wong ..... B63B 43/14 114/123

OTHER PUBLICATIONS

Anoynmous, "Straight Line Action Clamps for Assembly, Testing & More", Catalog Product, Mar. 15, 2024, DESTACO.

* cited by examiner

*Primary Examiner* — Evan P Dzierzynski
(74) *Attorney, Agent, or Firm* — Hayes Soloway P.C.

(57) ABSTRACT

A vessel stabilizing apparatus comprising a frame, two extender assemblies secured to the frame parallel to each other, two elongated floats secured parallel to each other at opposite ends of the extender assemblies, and two clamp assemblies adjustably secured to the telescoping member assemblies between the frame and a respective float, the clamp assemblies having a length that spans a distance between the extender assemblies, wherein the two clamp assemblies are configured to clamp the vessel stabilizing apparatus to opposing gunwales of a vessel, thereby positioning the two elongated floats outboard of the vessel and stabilizing the vessel against capsizing and distributing the clamping forces along the vessel.

20 Claims, 8 Drawing Sheets

VESSEL STABILIZING APPARATUS

BACKGROUND OF THE INVENTION

1. Field of the Invention

The invention is in the field improving the safety of vessels, particularly canoes, by reducing capsizing by improving buoyancy using outboard floating members.

2. Description of the Related Art

A canoe is a narrow, keelless boat with pointed ends. Therefore, they have little inherent stability and are prone to capsizing. Canoes have the benefits of being inexpensive, portable, and well-suited for recreation on the water. However, the constant threat of capsizing when fishing or carrying multiple occupants creates a dangerous situation that needs to be addressed.

Others have attempted to improve the stability of canoes. U.S. Pat. No. 4,641,594 by Birkett discloses a "canoe conversion kit" for converting a canoe to an iceboat or a sailboat. Birkett has two pontoons attached to two arms. It has a framework that is screwed into a canoe that is heavy and complex since it is adding a mast for a sail. It is so heavy that the patent calls for the kit to be carried on a trailer or other vehicle.

U.S. Pat. No. 1,336,688 by Ferko discloses a stabilizer for row boats, motor boats, and sailboats that has a pair of retractable stabilizer floats and two arms connecting each float to the vessel. However, the structure is very complex and is permanently attached to the vessel. It is not portable or removable, and is not particularly relevant to canoes.

U.S. Pat. No. 5,582,126 by Rypinski discloses a modular watercraft system for adding stabilizing amas to a main hull such as a canoe. There are two retractable trimaran connectors that can extend or retract the amas by rotating them on pivots at the vessel gunwale using lines, blocks, and a winch. This design has the disadvantage of concentrating stress at the pivot which can lead to an early failure of the system due to stress concentration. What is needed, therefore, is a vessel stabilizing apparatus and kit that does not have the disadvantages of the above disclosures that is suitable for canoes and the like. The apparatus and kit should be readily detachable without screws or bolts, lightweight, and sufficiently portable that it can be carried by its own handle.

SUMMARY OF THE INVENTION

The present invention is a vessel stabilizing apparatus and kit that satisfies these needs. The vessel stabilizing apparatus comprises a frame, two sets of extender assemblies secured to the frame parallel to each other, two elongated floats secured parallel to each other at opposite ends of the extender assemblies, and two clamp assemblies adjustably secured to the extender assemblies between the frame and a respective float, the clamp assemblies having a length that spans a distance between the elongated members, wherein the two clamp assemblies are configured to clamp the vessel stabilizing apparatus to opposing gunwales of a vessel, thereby positioning the two elongated floats outboard of the vessel and stabilizing the vessel against capsizing and distributing the clamping forces along the vessel. The features, functions, and advantages can be achieved independently in various embodiments of the present disclosure or may be combined in yet other embodiments in which further details can be seen with reference to the following description and drawings.

BRIEF DESCRIPTION OF DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION OF THE INVENTION

Figure 1:
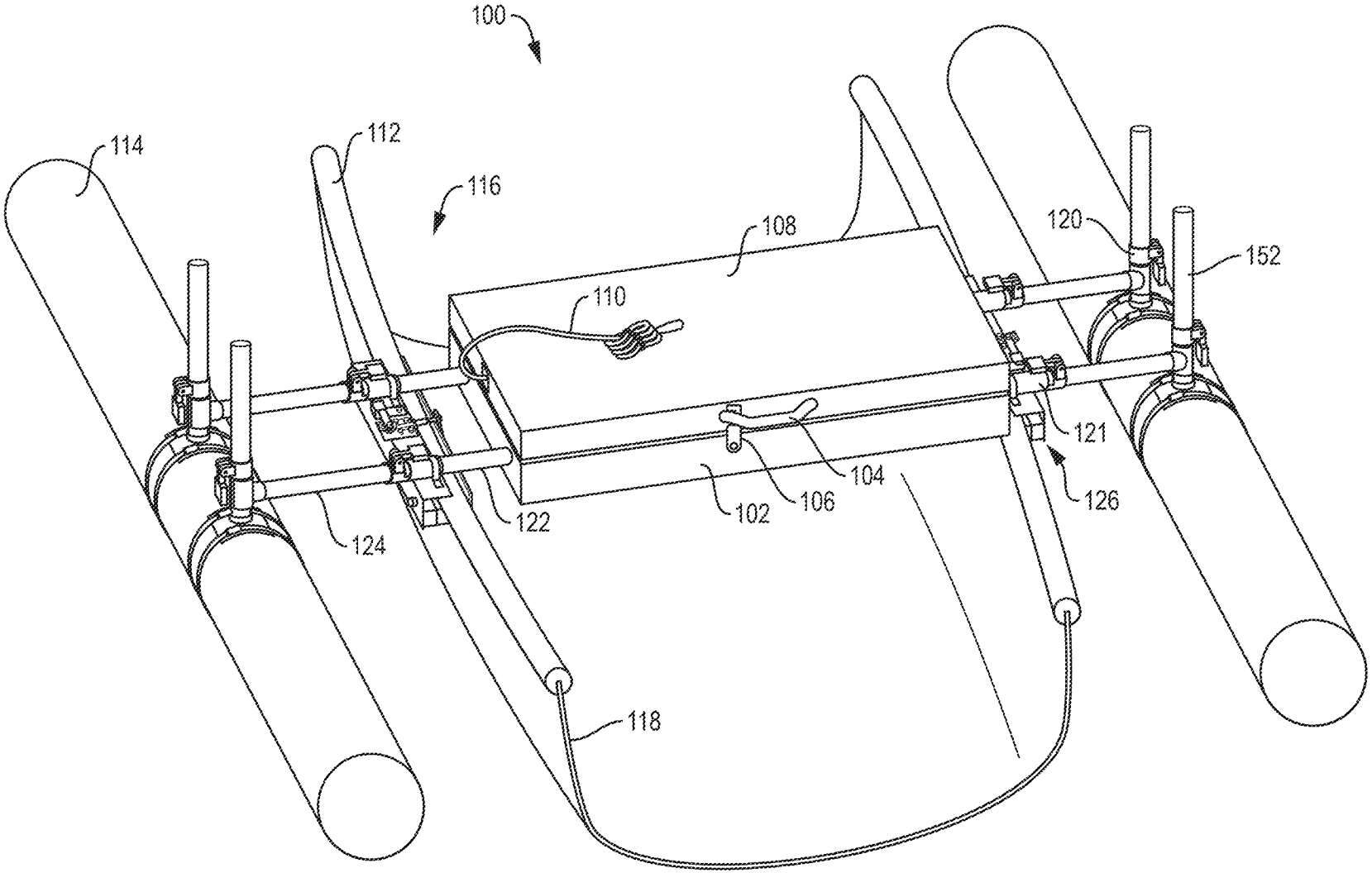
FIG. 1 is an orthogonal view of a vessel stabilizing apparatus installed onto a vessel.

A vessel stabilizing apparatus 100 according to the present invention is shown in the orthogonal view of FIG. 1. The apparatus comprises a frame 102, two extender assemblies 126 secured to the frame and parallel to each other in a spaced relationship, two elongated floats 114 secured parallel to each other to opposite ends of the two extender assemblies, and two clamp assemblies 116. Each clamp assembly is adjustably secured to the two extender assemblies between the frame and a respective elongated float. The clamp assemblies 116 have a length that spans a distance between the extender assemblies 126. The frame 102 is shown as substantially rectangular, but can be made in other shapes.

The two extender assemblies 126 each comprise a first set of extenders 122, a second set of extenders 124 and quick non-tool securing apparatus 121 attached to the extender assemblies 126 outboard of the frame 102 for adjusting the overall length of the extender assemblies. The extender assemblies terminate at a distal end at a vertical pressure lock 120 configured to accept a respective perpendicular vertical stabilizer adjustment arm 152. Two stabilizer adjustment arms are secured to respective elongated floats 114 at a distance substantially equal to the distance between the two extender assemblies. Additional vertical pressure locks 120 are provided on each respective stabilizer adjustment arm and are configured to adjust a vertical height of the two elongated floats relative to the vessel 118. As used in this description and in the claims, the terms "vertical pressure locks" 120 and "quick non-tool securing apparatus" 121 can include flip lever clamps that secure and/or lock tubes, such as telescoping tubes, together at a desired configuration by the action of flipping a lever or other action that does not require a separate tool. The term "quick" in this context in this description and in the claims means that a securing the components together is quick because it does not require the operator seeking and utilizing a separate tool.

Each elongated float 114 can comprise a hard, waterproof exterior and filled with a waterproof, buoyant filler. An example of a waterproof exterior is Schedule 20 PVC pipe, sealed at each end. The waterproof, buoyant filler could be polyethylene foam, such as pool noodle material, disposed within the PVC pipe, thereby making the floats unsinkable.

The apparatus 100 also comprises a photovoltaic solar panel or table 108 disposed on a top side of the frame 102. The solar panel has an output electric cord 110 and is useful for charging a battery and/or powering an electric motor attached to the vessel. The solar panel or table preferably has a handle 104 on one side suitable for carrying the apparatus. A handle clasp 106 is used to secure the solar panel or table 108 to the frame 102 when the apparatus is in use or being carried.

As shown in FIG. 1, the two clamp assemblies 116 camp the vessel stabilizing apparatus 100 to opposing gunwales 112 of a vessel 118, thereby securing the two elongated floats 114 outboard of the vessel and stabilizing the vessel against capsizing. The vessel can be a canoe, an aluminum boat, a dinghy, a skiff, or similar boat that has approximately vertical gunwales. The two clamp assemblies are configured to be releasably adjusted to a desired distance between them using the adjustable extender assemblies. The desired distance corresponds to a distance between gunwales of different vessels. In this way, the clamp assemblies are configured to be releasably secured to different vessels. The vessel stabilizing apparatus is therefore not limited to one size of vessel. The same vessel stabilizing apparatus can be used on vessels of different sizes.

Figure 2:
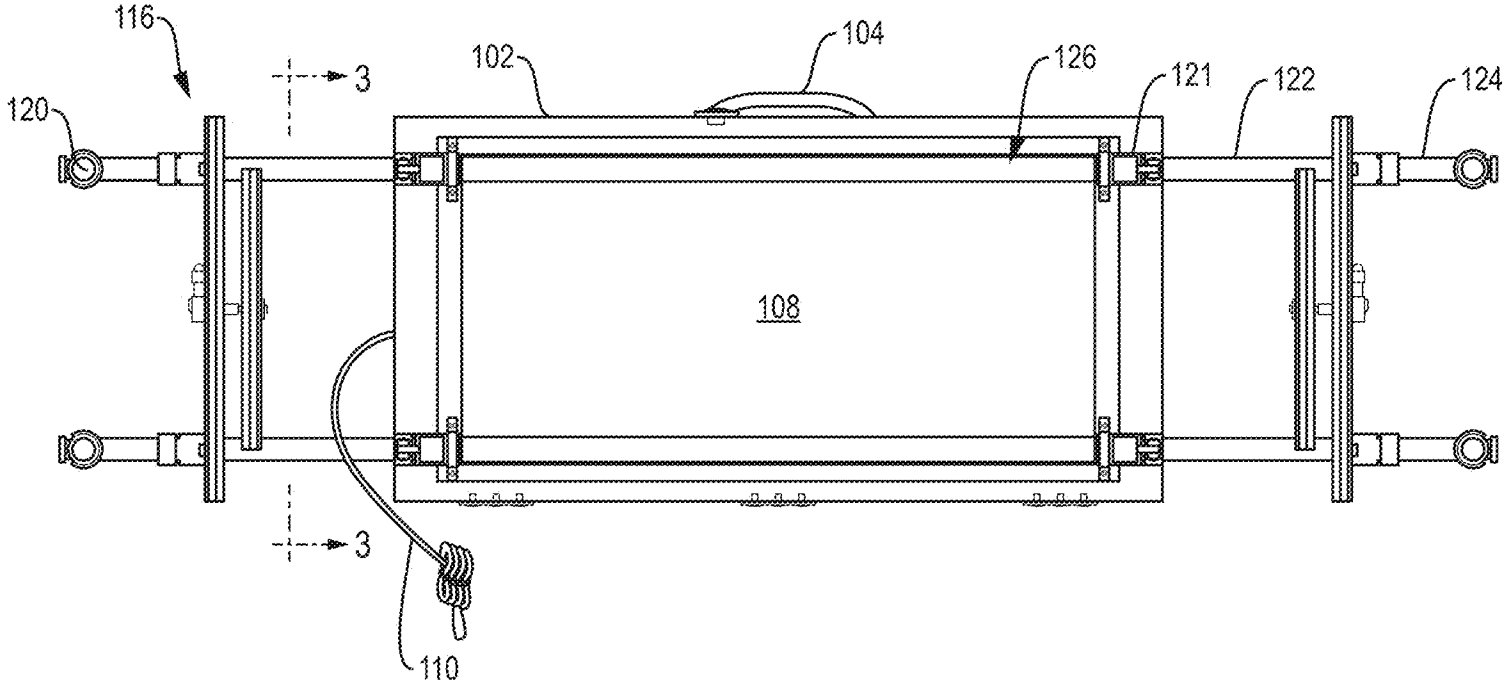
FIG. 2 an underside view of a vessel stabilizing apparatus.

FIG. 2 is an underside view of the vessel stabilizing apparatus shown apart from the vessel. This view shows more details of the clamp assemblies 116, and the presence of four additional quick non-tool securing apparatuses 121 inboard of the outside perimeter of the frame 102, and are secured to a bottom side of the frame. The quick non-tool securing apparatuses, like the ones shown in FIG. 1, allow further adjustment of the overall length of the extender assemblies 126, and securing them at a desired length.

Figure 3:
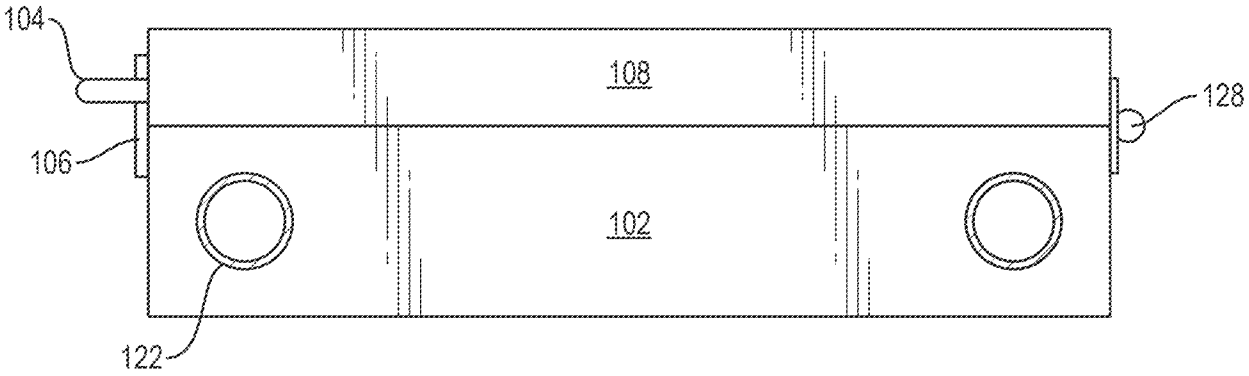
FIG. 3 is a cross sectional view of FIG. 2 showing the relationship between the two extender assemblies, frame, handle, and hinge.

The cross sectional view of FIG. 3 is a cross section of FIG. 2 and shows how the first set of extenders 122 as part of the extender assemblies 126 may be secured within holes in the frame 102. FIG. 3 also shows a hinge 128 joining the frame 102 and the solar panel or table 108 at a side opposite that of the handle 104. In use, an operator sitting in the vessel can release the clasp 106 from the handle 104 to lift open the solar panel or table 108 to gain access to the quick non-tool securing apparatuses 121 secured to the bottom of the frame, or to gain access to a battery that is used to operate an electric motor for operating the vessel. The operator may then release the quick non-tool securing apparatuses to adjust the length of the extenders of the extender assemblies 126 to a desired length, and then secure the quick non-tool securing apparatuses 121.

Figure 4:
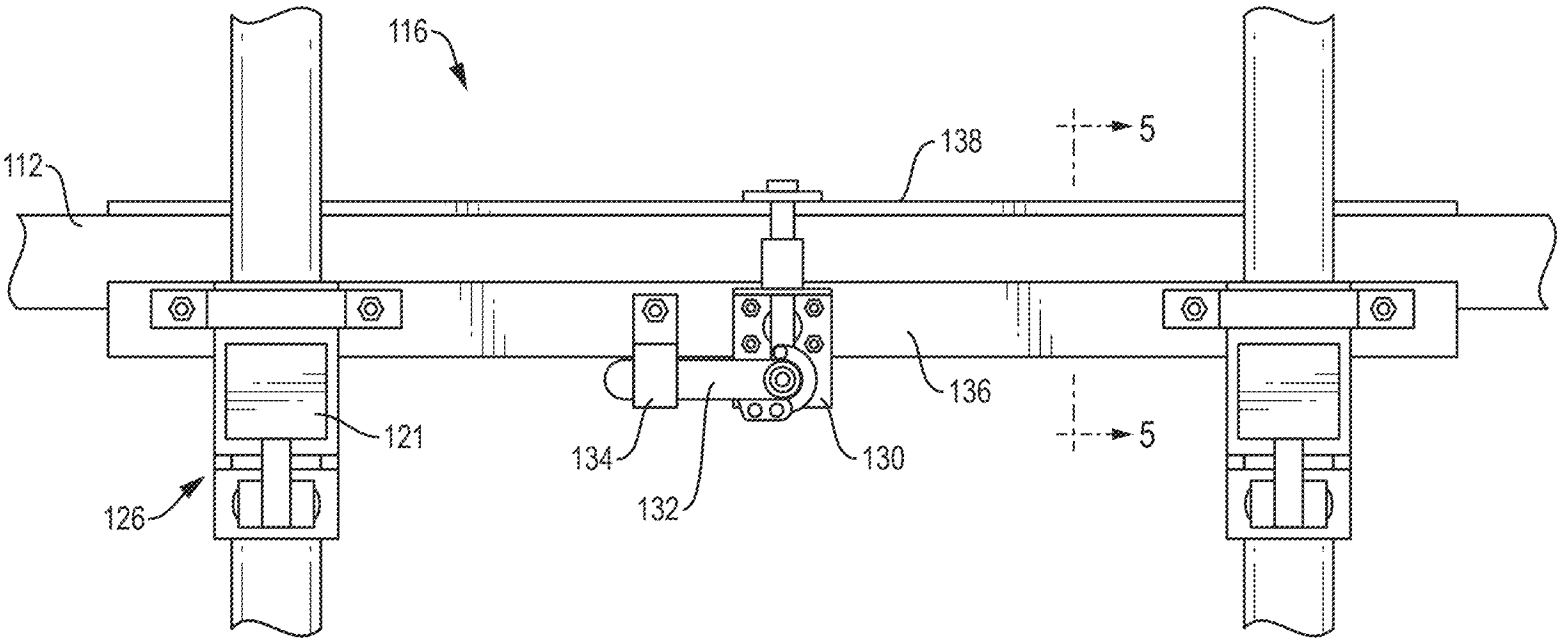
FIG. 4 is detail view of a clamp assembly.

FIG. 4 is a plan view showing details of one of the two clamp assemblies 116. The clamp assembly comprises a first clamp jaw 136 and a second clamp jaw 138, with the first clamp jaw disposed outboard of the second clamp jaw. The clamp jaws can be made of metal, plastic, graphite, or fiberglass. If made of plastic, they can be made of blow molded plastic. The two extender assemblies 126 are attached via their respective quick non-tool securing apparatuses 121 to the first clamp jaw 136. They can be attached via straps 140 or other attachment devices that are well-known to persons having ordinary skill in the art.

Each clamp assembly 116 also as a respective single lever clamp 130 attached thereto, the single lever clamp having a proximal end and a distal end. The single lever clamp proximal end is attached to the first clamp jaw 136, and the single lever clamp distal end is attached to the second clamp jaw 138. Each single lever clamp 130 proximal end also has a lever 132 for operating the clamp. The first clamp jaw may have a latch 134 for securing the single lever clamp in a closed position.

In operation, the lever 132 is first in an open position such that first clamp jaw and second clamp jaw are also in an open position, with the jaws the furthest apart. An operator places the clamp assembly over a gunwale 112 of a vessel and then operates the lever, which draws the first clamp jaw 136 and second clamp jaw 138 together, thereby securing the apparatus to the vessel with one action of the lever.

Figure 5:
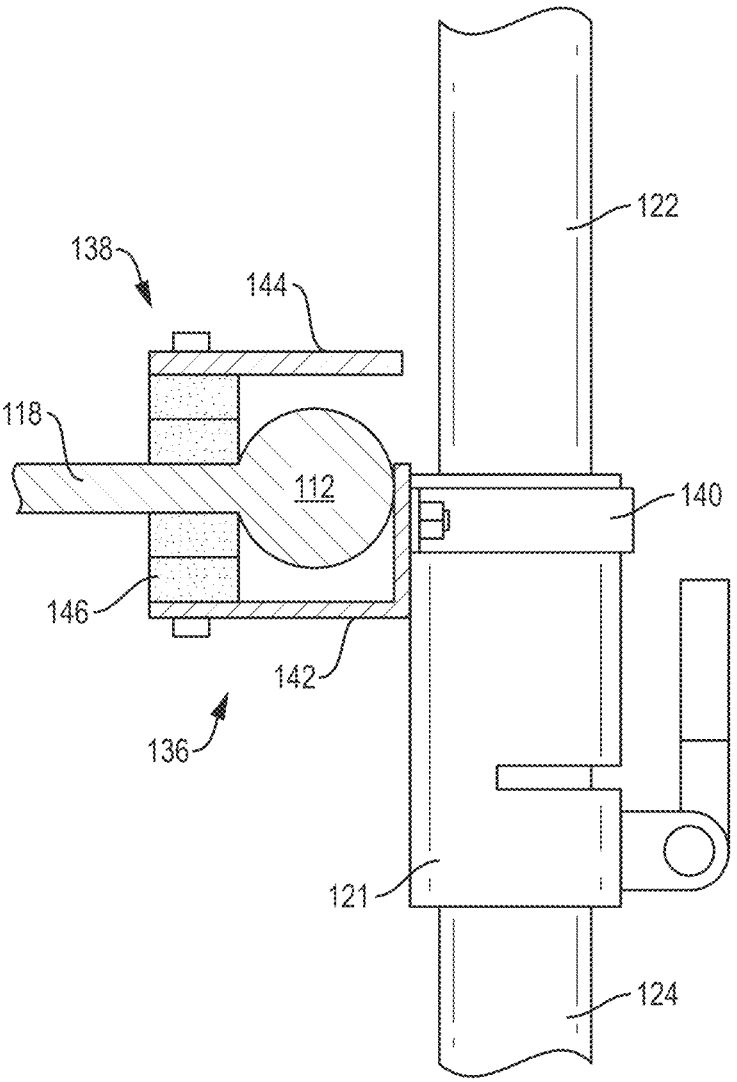
FIG. 5 is a cross section from FIG. 4 showing how the clamp assembly clamps onto a vessel.

FIG. 5 is a cross section of FIG. 4 that shows some of the details of the clamp jaws. The first clamp jaw 136 can comprise a structural angle 142 that has quick non-tool securing apparatuses 121 secured to its top by straps 140. A vertical side of the angle 142 can have a pad 142 attached thereto that can be any resilient, soft, non-slip pad, such as a rubber pad. The second clamp jaw 138 can comprise a plate 144 that can have another resilient pad 142 attached thereto. When the single-lever clamp is closed, the clamp assembly is releasably secured to the vessel and is captured by the vessel's gunwale 112.

Figure 6:
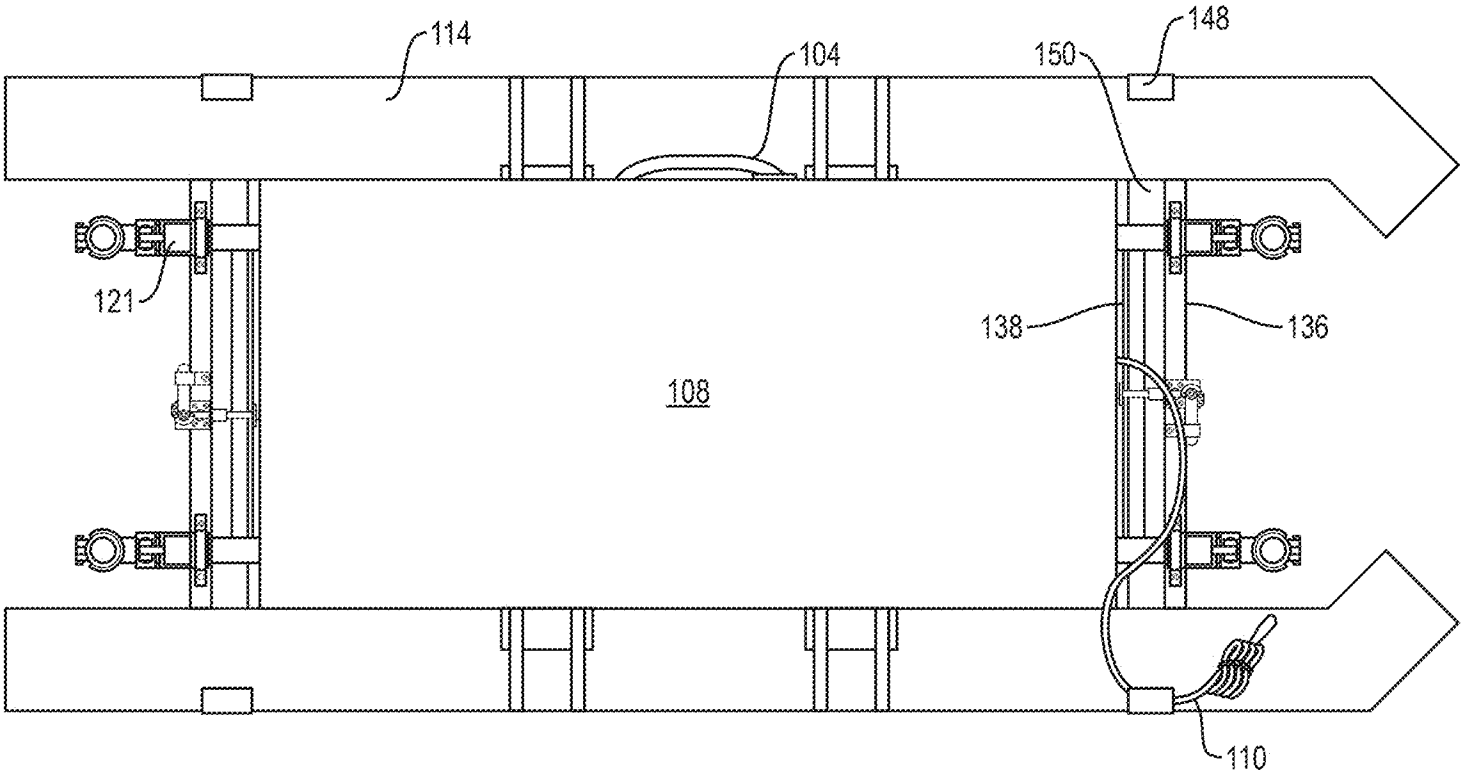
FIG. 6 is a plan view of the vessel stabilizing apparatus in a collapsed configuration for transportation.

FIG. 6 is a plan view of the vessel stabilizing apparatus in a collapsed configuration for transportation. In this view, all of the extender assemblies have been retracted to a minimum length and the elongated floats 114 have been detached. Mobile locking stabilizer brackets 148 are attached around the floats 114 to secure the assembly together so that it can carried by the handle 104.

Figure 7:
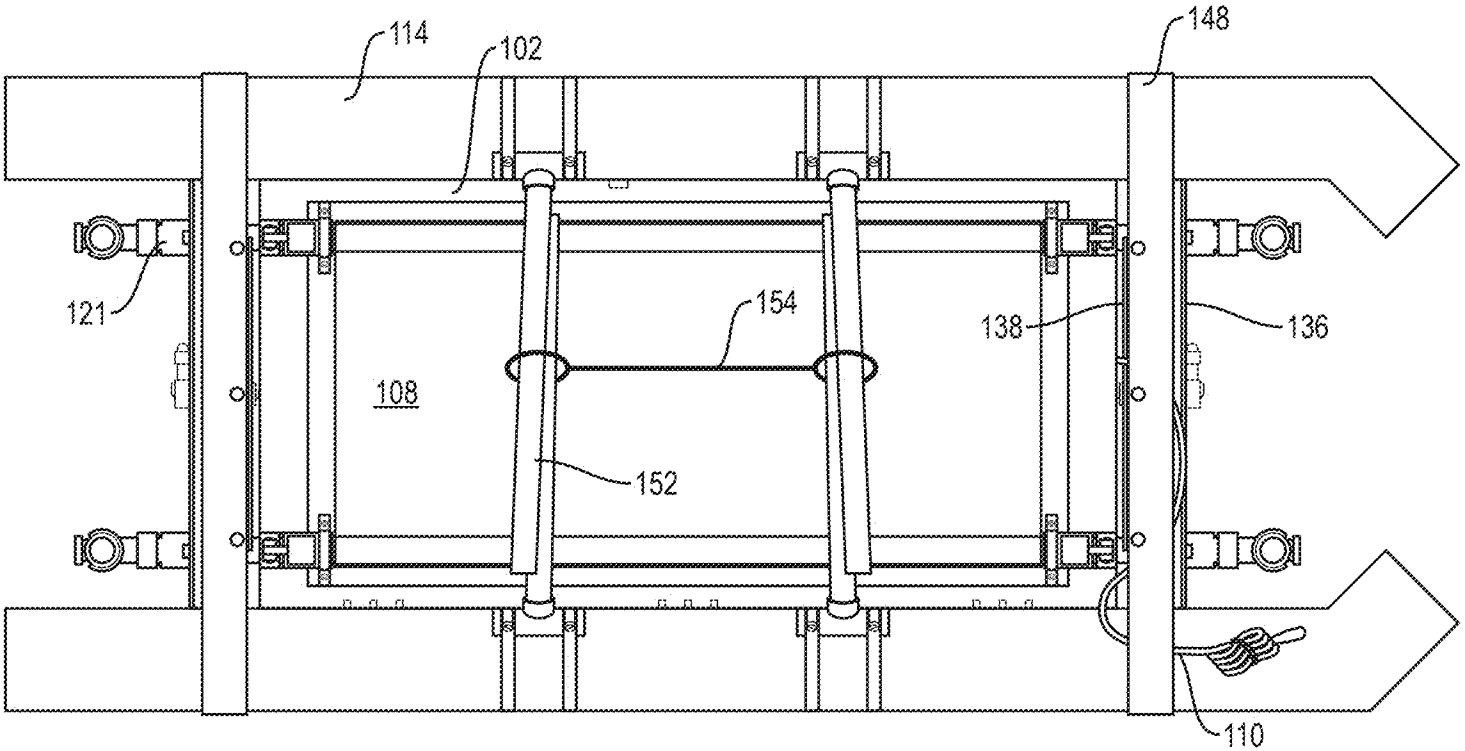
FIG. 7 is an underside view of the configuration of FIG. 6.

FIG. 7 is an underside view of the configuration of FIG. 6. This view shows mobile locking stabilizer brackets securing the floats 114 to the rest of the assembly. The stabilizer adjustment arms 152 of the floats have been detached from the assembly and are secured for transport by a cord, rope, or strap 154.

Figure 8:
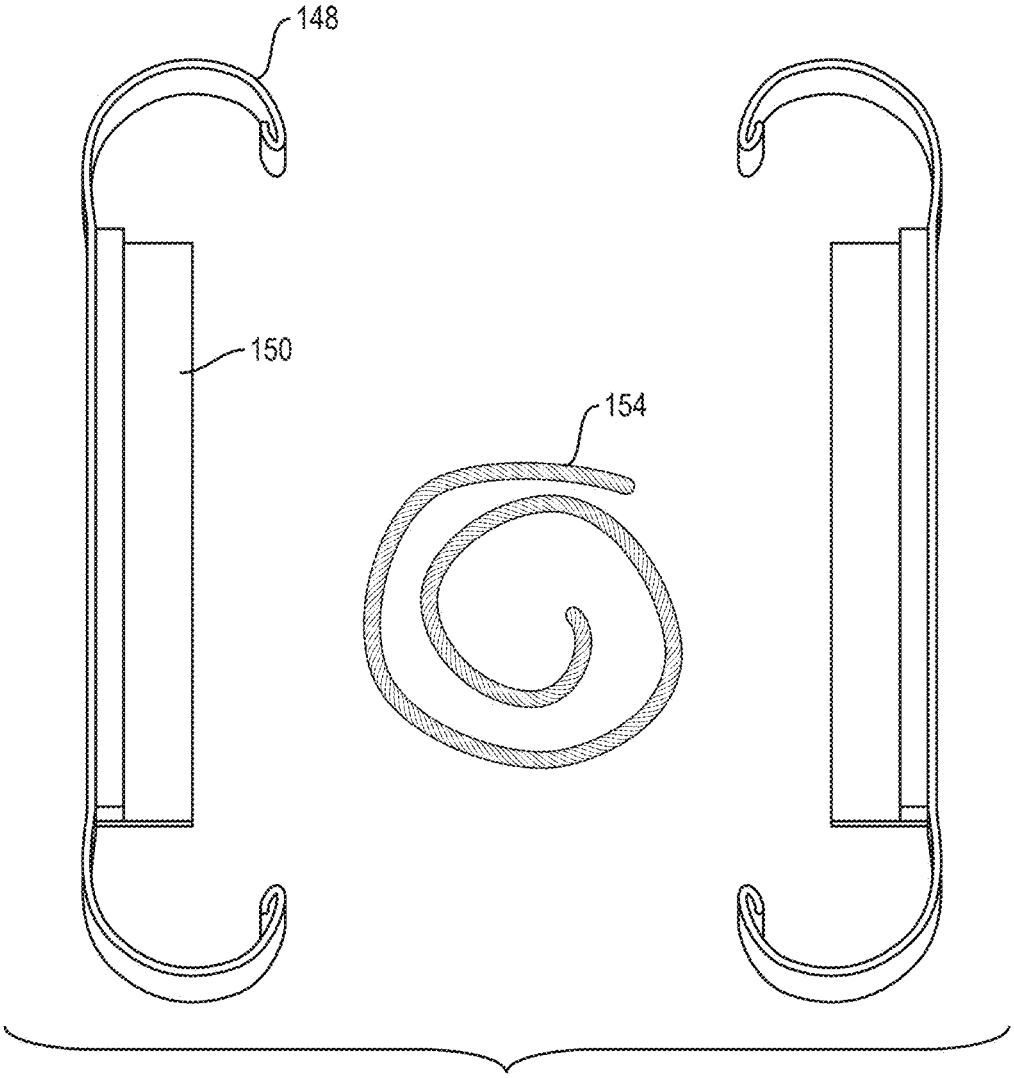
FIG. 8 is a detail view of retaining equipment used for transporting the apparatus in the configuration of FIG. 6 and FIG. 7.

FIG. 8 is a detail view of retaining equipment used for transporting the apparatus in the configuration of FIG. 6 and FIG. 7. The retaining equipment comprises a plurality of mobile locking stabilizer brackets 148 and at least one cord, rope, or strap 154. The retaining equipment can also have a retainer spacer 150 attached to the inside of the mobile locking stabilizer brackets. When installed, the retainer spacer separates the first clamp jaw 136 and second clamp jaw 138 during transportation.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

The invention claimed is:

1. A vessel stabilizing apparatus (100) comprising:

a frame (102);

two extender assemblies (126) secured to the frame and parallel to each other in a spaced relationship;

two elongated floats (114) secured parallel to each other to opposite ends of the two extender assemblies; and two clamp assemblies (116), each clamp assembly adjustably secured to the two extender assemblies between the frame and a respective elongated float, the clamp assemblies having a length that spans a distance between the extender assemblies, wherein the two clamp assemblies are configured to be releasably adjusted to a desired distance between them by the extender assemblies and clamp the vessel stabilizing apparatus to opposing gunwales (112) of a vessel (118), thereby securing the two elongated floats outboard of the vessel and stabilizing the vessel against capsizing, and configured to be releasably secured to other vessels of different sizes.

2. The apparatus of claim 1, further comprising a photovoltaic solar panel or a table (108) disposed on a top of the frame.

3. The apparatus of claim 2, further comprising a handle (104) attached to a first side of the solar panel or table (108), wherein the apparatus is (100) configured to be transported by the handle.

4. The apparatus of claim 3, further comprising a hinge (128) joining the frame (102) and the solar panel or table (108) at a second side opposite the first side, such that that lifting the handle (104) provides access to an underside of the frame.

5. The apparatus of claim 1, the vessel selected from a group consisting of a canoe, an aluminum boat, a dinghy, and a skiff.

6. The apparatus of claim 1, further comprising:

a respective pair of stabilizer adjustment arms (152) secured to each of the two elongated floats (114) at a distance substantially equal to a distance between the two extender assemblies (126); and a respective bracket (122) secured at each end of the two extender assemblies configured to receive a respective stabilizer adjustment arm, wherein the brackets and stabilizer adjustment arms are configured to adjust a vertical height of the two elongated floats relative to the vessel (118).

7. The apparatus of claim 1, the clamp assemblies each comprising a single lever clamp (130) having a lever (132).

8. The apparatus of claim 7, the clamp assemblies (116) each comprising a latch (134) configured to prevent the lever from inadvertently releasing the clamp.

9. The apparatus of claim 1, the two extender assemblies (126) comprising:

a first set of extenders (122);

a second set of extenders (124); and quick non-tool securing apparatuses (121) attached to the first and second extenders and configured for adjusting an overall length of the two extender assemblies.

10. The apparatus of claim 9, the clamp assemblies (116) comprising clamp jaws (136, 138) made of metal, plastic, graphite, or fiberglass.

11. The apparatus of claim 10, the clamp jaws comprising a respective first clamp jaw (136) and a second clamp jaw (138) on each side of the apparatus (100);

the first clamp jaw disposed outboard of the second clamp jaw;

the quick non-tool securing apparatuses (121) comprising respective quick non-tool securing apparatuses attached to each extender assembly (126) at a location outboard of the frame (102);

each respective quick non-tool securing apparatus attached to a first clamp jaw.

12. The apparatus of claim 11, further comprising two single lever clamps (130) each having a proximal end and a distal end;

each respective single lever clamp proximal end attached to a respective first clamp jaw (136);

each respective single lever clamp distal end attached to a respective second clamp jaw (138), whereby operating the single lever clamp securely engages the gunwale (112) of the vessel (118) by drawing the first clamp jaw and the second clamp jaw together.

13. The apparatus of claim 10, wherein the clamp jaws (136, 138) are made of metal, the clamp assemblies (116) further comprising pads (146) disposed at a location of the clamp jaws where the clamp jaws contact the vessel (118).

14. The apparatus of claim 10, wherein the clamp jaws (136, 138) are made of plastic.

15. The apparatus of claim 9, the quick non-tool securing apparatuses (121) comprising a respective quick non-tool securing apparatus attached to each extender assembly (126) at a location underneath the frame (102).

16. The apparatus of claim 1, the two elongated floats (114) comprising a hard, waterproof exterior filled with a waterproof, buoyant filler, thereby making the floats unsinkable.

17. A canoe stabilizing apparatus (100) comprising:

a frame (102);

a photovoltaic solar panel or a table (108) disposed on a top of the frame;

two extender assemblies (126) secured to the frame and parallel to each other in a spaced relationship;

two elongated floats (114) secured parallel to each other to opposite ends of the two extender assemblies; and two clamp assemblies (116), each clamp assembly adjustably secured to the two extender assemblies between the frame and a respective elongated float, the clamp assemblies having a length that spans a distance between the extender assemblies, wherein the two clamp assemblies are configured to be releasably adjusted to a desired distance between them by the extender assemblies and clamp the canoe stabilizing apparatus to opposing gunwales (112) of a canoe (118), thereby securing the two elongated floats outboard of the vessel and stabilizing the canoe against capsizing, and configured to be releasably secured to other canoes of different sizes.

18. The apparatus of claim 17, the clamp assemblies (116) comprising:

a respective first clamp jaw (136); and a second clamp jaw (138) on each side of the apparatus (100);

the first clamp jaw disposed outboard of the second clamp jaw;

respective quick non-tool securing apparatuses (121) attached to each extender assembly (126) at a location outboard of the frame (102);

each respective quick non-tool securing apparatus attached to a first clamp jaw.

19. A canoe stabilizing apparatus (100) comprising:

a frame (102);

a photovoltaic solar panel or a table (108) disposed on a top of the frame;

two extender assemblies (126) secured to the frame and parallel to each other in a spaced relationship;

two elongated floats (114) secured parallel to each other to opposite ends of the two extender assemblies; and two clamp assemblies (116), each clamp assembly adjustably secured to the two extender assemblies between the frame and a respective elongated float, the clamp assemblies having a length that spans a distance between the elongated members, the two clamp assemblies configured to be releasably adjusted to a desired distance between them by releasably adjusting the two extender assemblies, the clamp assemblies comprising:

a respective first clamp jaw (136); and a second clamp jaw (138) on each side of the apparatus (100);

the first clamp jaw disposed outboard of the second clamp jaw;

two single lever clamps (130) each having a proximal end and a distal end;

each respective single lever clamp proximal end attached to a respective first clamp jaw;

each respective single lever clamp distal end attached to a respective second clamp jaw, whereby operating the single lever clamp securely engages a gunwale (112) of a canoe (118) by drawing the first clamp jaw and the second clamp jaw together and clamp the canoe stabilizing apparatus to opposing gunwales of the canoe, thereby securing the two elongated floats outboard of the canoe and stabilizing the canoe against capsizing, and the two clamp assemblies configured to be releasably secured to other canoes of different sizes by releasably adjusting the two extender assemblies.

20. The apparatus of claim 19, wherein the clamp jaws (136, 138) are made of metal, the clamp assemblies (116) further comprising pads (146) disposed at a location of the clamp jaws where the clamp jaws contact the canoe (118).

* * * * *